US006866145B2

(12) United States Patent
Richards et al.

(10) Patent No.: US 6,866,145 B2
(45) Date of Patent: Mar. 15, 2005

(54) COMPARTMENTALIZED STORAGE SYSTEM FOR TEMPORARILY STORING AND SUBSEQUENTLY MIXING AT LEAST TWO DIFFERENT SUBSTANCES

(75) Inventors: Randall G. Richards, Canton, GA (US); Keith Anthony Jones, Lynchburg, VA (US); Colin Berido, Bagshot (GB)

(73) Assignee: Bush Boake Allen, Inc., Montvale, NJ (US)

( * ) Notice: Subject to any disclaimer, the term of this patent is extended or adjusted under 35 U.S.C. 154(b) by 28 days.

(21) Appl. No.: 10/002,972

(22) Filed: Oct. 26, 2001

(65) Prior Publication Data

US 2003/0031764 A1 Feb. 13, 2003

(30) Foreign Application Priority Data

Oct. 31, 2000 (GB) ..... 0026605

(51) Int. Cl.[7] ..... B65D 25/08
(52) U.S. Cl. ..... 206/219
(58) Field of Search ..... 426/115, 120, 426/130; 206/219–222; 220/501

(56) References Cited

U.S. PATENT DOCUMENTS 3,567,105 A * 3/1971 McFarlin ..... 229/15
3,744,625 A 7/1973 Chin
4,462,224 A * 7/1984 Dunshee et al. ..... 206/219
4,805,767 A * 2/1989 Newman ..... 206/219
4,880,111 A * 11/1989 Bagwell et al. ..... 206/209.1
4,986,076 A * 1/1991 Kirk et al. ..... 206/219
5,058,738 A * 10/1991 Svensson ..... 206/229
5,287,961 A * 2/1994 Herran ..... 206/219
5,353,927 A * 10/1994 Stupar et al. ..... 206/219
5,616,337 A * 4/1997 Kasianovitz et al. ..... 424/414
5,881,859 A * 3/1999 Hudson ..... 206/219
5,967,308 A * 10/1999 Bowen ..... 206/219
6,036,004 A * 3/2000 Bowen ..... 206/219
6,062,381 A * 5/2000 Paley et al. ..... 206/223
6,254,907 B1 7/2001 Galomb
6,491,159 B2 * 12/2002 Shibata ..... 206/219

FOREIGN PATENT DOCUMENTS

WO WO 94/19257 9/1994

* cited by examiner

*Primary Examiner*—Shian T. Luong
(74) *Attorney, Agent, or Firm*—Richard R. Muccino

(57) ABSTRACT

The present invention is directed to a compartmentalized storage system for temporarily storing and subsequently mixing at least two different substances. The compartmentalized storage system comprises a first storing compartment, with an optional a tearable seal, containing a solid sorbing substrate, such as a wipe, and a first substance. The compartmentalized storage system further comprises a second storing compartment having a second substance. The first and the second compartments are attached to each other by at least one common side, which common side comprises a frangible seal connecting the first and the second compartments. By applying force to the frangible seal, the seal will break and thereby allow the second substance in the second storing compartment to be mixed with the solid sorbing substrate and the first substance in the first storing compartment.

15 Claims, 3 Drawing Sheets

COMPARTMENTALIZED STORAGE SYSTEM FOR TEMPORARILY STORING AND SUBSEQUENTLY MIXING AT LEAST TWO DIFFERENT SUBSTANCES

This application claims priority from United Kingdom Patent Application Serial no. 0026605.6, filed Oct. 31, 2000.

FIELD OF THE INVENTION

The present invention is directed to a compartmentalized storage system for temporarily storing and subsequently mixing at least two different substances. The compartmentalized storage system comprises a first storing compartment having a front and a back, and a plurality of sides, defining a first cavity portion. The first storing compartment may optionally include a tearable seal. A solid sorbing substrate, such as a wipe, and a first substance are stored in the first storing compartment. The compartmentalized storage system further comprises a second storing compartment having a front and a back and a plurality of sides, defining a second cavity portion. A second substance is stored in the second storing compartment. The first and the second compartments are attached to each other by at least one common side, which common side comprises a frangible seal connecting the first and the second compartments. By applying force to the frangible seal, the seal will break and thereby allow the second substance in the second storing compartment to be mixed with the solid sorbing substrate and the first substance in the first storing compartment. The present invention is also directed to a compartmentalized storage system for temporarily storing and subsequently mixing at least two different edible substances. The present invention is further directed to methods for using the compartmentalized storage systems to temporarily store and subsequently mix at least two different substances.

DESCRIPTION OF THE BACKGROUND

Various forms of impregnated nonwoven fabrics are available for performing a wide variety of tasks such as cleaning hands and other areas of the body, cleaning hard surfaces, and delivering active agents to various surfaces. Such fabrics are marketed as wipes and are ready for use either in individual packet form or in bulk form in suitable dispensers from which the individual wipes can be withdrawn as needed. Compartmented containers, with or without wipes, are known in the art.

U.S. Pat. No. 4,185,754 (Jilius) discloses a disposable moisture impermeable limp-pack package for containing and dispensing moisture impregnated towelettes. The package comprises a thin sheet of limp-pack flexible material having an opening which is hermetically sealed defining a container completely enclosing the towelettes. A cap for the opening in the flexible material provides a moisture impermeable resealable closure for accessing and removing the towelettes contained in the package. The cap includes a resealable cap, a hinge, and a circumferential collar. The hinge attaches the cap to the circumferential collar. The collar is mounted on the thin sheet of flexible material at the opening to provide a moisture impermeable seal.

U.S. Pat. No. 4,335,731 (Bora, Jr.) discloses a disposable dental wipe for dental hygiene adapted to be wrapped around a finger for better sensitivity and pressure control against the teeth and gums. The disposable dental wipe comprises a flexible honeycombed flat sheet of soft foam material having outer and inner faces and formed of a flexible resilient material. Bristles integral with the material extend outwardly from the outer face of the sheet. A stripe of contact adhesive is mounted on the sheet for securing the material when it is wrapped around a finger. The sheet is impregnated with a dentifrice which flows through the sheet upon application of pressure with the finger against the teeth and gums. The disposable dental wipe may be wrapped around a finger and may be directed and pressed by the finger in between teeth, in back of a row of teeth, and against gums and teeth with finger sensitivity to provide a positive wiping force.

U.S. Pat. No. 4,550,855 (Harrison) discloses a moist towelette dispenser package containing a supply of moist towelettes in a continuous zigzag folded web and separated by perforations. The package comprises an envelope having a towelette holding portion and a closure flap portion separated from one another by a transverse fold line. The envelope is formed from an upper and a lower sheet of flexible, moisture-impervious material. The sheets are of the same overall outer dimensions and sealed to one another around the outer edges. The upper sheet has an adhesive area and a dispensing opening positioned on the flap portion. The dispensing opening and adhesive area are located equidistant from the fold line so that when the flap portion is folded over the towelette holding portion along the fold line, the opening is completely sealed by the adhesive area against the towelette holding portion. The perforations in the folded web provide for separation of each towelette from the supply so that, on withdrawal and separation of each towelette, the end of the next towelette in the web is left entirely within the envelope package.

U.S. Pat. No. 4,615,937 (Bouchette) discloses an antimicrobially active, non-woven web comprising bonded fibers, a binder distributed on the fibers, and an antimicrobial agent distributed on the fibers. The antimicrobial agent is substantive to the fibers and to the binder when the web is either wet or dry to prevent the antimicrobial agent from diffusing from the fibers or the binder.

U.S. Pat. No. 4,896,768 (Anderson) discloses a presaturated wipe product for applying an active disinfectant solution to a work surface. The wipe product comprises a first layer of packaging material, a second layer of packaging material, a pad secured to the second layer, and a dilute glutaraldebyde solution impregnated in the pad for providing disinfecting activity to the pad. The first layer and the second layer are heat sealed to each other to form a sealed envelope for maintaining the presaturated pad. The presaturated pad is irradiated after the first and second layers are heat sealed so that the envelopes maintain disinfecting activity for the glutaraldehyde over an extended period of time.

U.S. Pat. No. 4,904,524 (Yoh) discloses a porous sheet impregnated with an aqueous lotion comprising a hydrophobic functional ingredient entrapped in polymeric beads. The entrapped ingredient is concentrated near the surface of the sheet.

U.S. Pat. No. 5,152,996 (Corey et al.) discloses a moistened, fibrous flexible nonwoven sheet material. The nonwoven sheet material consists essentially of cellulosic fibers impregnated with an aqueous composition comprising a zinc acetate peroxide complex and from 0.1% to 1.0% by weight of a surfactant selected from the group consisting of a 1:1 mixture by weight of N-alkyl dimethyl benzyl ammonium chloride and N-alkyl dimethylethylbenzyl ammonium chloride; N-alkylbenzene sulfonates sodium salt, wherein alkyl has an average of 11 carbon atoms; cocoamphocarboxypropionate; and lauryl diethanolamine oxide.

U.S. Pat. No. 5,368,581 (Smith et al.) discloses a method for applying dermatological agents to the skin from a single dispensing and applicator system. The method comprises providing a dispensing and applicator system having a flexible moisture impermeable support sheet. Applicator pads are affixed in a separated array to one surface of the support sheet. Each of the pads is impregnated with a composition comprising a different dermatological agent. The support sheet and pads are folded to enclose the pads. The opposing peripheral surfaces of the support sheet are sealed together to form a compartment containing the pads and are defined by a continuous peripheral seal. The peripheral seal is positioned inward from the edges of the sheets over a portion of the opposed peripheral surfaces to form two opposed flanges. The opposing surfaces of the support sheet are together between each of the pads to divide the compartment into subcompartments each containing one of the pads. The flanges are manually grasped and separated to partially separate the two opposed surfaces of the support sheet so that the pads are exposed. The pads are contacted with the skin to release the compositions simultaneously from the pads to apply a film of a mixture of the agents on the skin.

U.S. Pat. No. 5,639,532 (Wells) discloses a multilayer cleansing kit. The kit comprises a first absorbent layer, a second absorbent layer impregnated with a cleaning solution, and an impermeable liner between the first and second absorbent layers to prevent the cleaning solution from passing from the second absorbent layer to the first absorbent layer. The first and second absorbent layers and the impermeable liner are laminated together to form a unitary device. The first absorbent layer extends beyond the second absorbent layer and the liner to form a flap can be folded relative to the kit.

U.S. Pat. No. 5,744,150 (Cercone) discloses an antimicrobial sponge material composition having a visual indication of an antimicrobial activity. The antimicrobial sponge material composition comprises a hydroxylated acetalized polyvinyl alcohol complexed with iodine and plasticized with a polyol. The sponge material composition has a yellow or gold colored surface and releases free iodine from the surface and changes surface color from a yellow or gold color to a black color upon surface contact with an aqueous fluid, thereby providing a visual indication that the antimicrobial activity of the sponge material composition has been activated by releasing free iodine.

U.S. Pat. No. 5,771,522 (Carmody) discloses a dental hygiene wipe comprising a flexible base substrate and an abrasive cleaning means. The abrasive cleaning means coextensively covers an upper surface of the flexible base substrate for abrasively cleaning exterior surfaces and interproximal areas of human teeth. The base substrate and the abrasive cleaning means are shaped so as to define intersecting linear edges which define corners at intersections of the linear edges. The comers are orthogonal comers which can be utilized as a pick to clean along a juncture of two adjacent teeth to clean debris from the juncture. The abrasive cleaning means has a flexible layer of material secured to the base substrate shaped to define raised quarter-spherical projections. The quarter-spherical projections extend in aligned rows and columns between the linear edges of the flexible base substrate. The quarter-spherical projections are shaped so as to define a semi-circular planar outer surface and a quarter-spherical outer surface which define a quarter-spherical shape of the projections. The semi-circular planar outer surface of each of the projections is oriented to reside within a plane oriented orthogonally relative to a plane containing the base substrate such that the quarter-spherical injections provide both a first degree of abrasion when moved in a first direction. The semi-circular planar outer surface of each of the projections leads motion of the abrasive cleaning means across a tooth, and a second degree of abrasion when moved in a second direction. The semi-circular planar outer surface of each of the projections follows the motion of the abrasive cleaning means across a tooth. The first degree of abrasion is greater than the second degree of abrasion.

U.S. Pat. No. 5,791,465 (Niki et al.) discloses a moist wipe package comprising moist wipes and a storing body in which the moist wipes are stored. The storing body is provided with an outlet opening through which the moist wipes are withdrawn. The outlet opening is covered with an opening-and closing-cover label detachably attached to the storing body. The storing body has a rectangular parallel-equipped body formed from a square sleeve shaped packing material having open opposite ends. The outlet opening is formed in one surface of the packing material. Opposing side edge portions of the one surface and/or opposing side edge portions of a surface opposite the one surface are made rigid so that they exhibit self-supporting properties. The one and the opposite surface are sealed together at the open opposite ends to form sealed opposite ends. The sealed opposite ends are fixed so that the one surface and the opposite surface form opposing two end faces of the rectangular parallelepiped body.

U.S. Pat. No. 5,813,080 (Hendren) discloses a towel structure comprising a towel formed in a first sleeve structure having a first absorbency relative to water and having first and second ends. A wipe is formed as a second sleeve structure having a second absorbency different from the first absorbency and is encompassed by the towel. A film is interposed between the towel and the wipe to inhibit transfer of the water from the towel to the wipe. A fastener fastens the towel, the wipe, and the film together.

U.S. Pat. No. 5,868,245 (Alt) discloses a sterile package for containment of a device to be inserted or implanted into the body of a patient and thereby in contact with blood and tissue of the body in a surgical or medical treatment procedure. The package comprises a container, the device enclosed within the container to maintain the sterility of the device during shipping, storage and handling of the package prior to opening the container and at least one swab impregnated with a solution of $H_2O_2$. The swab is packaged in a separate sterile pack incorporated in the sterile package and containing an adequate concentration of $H_2O_2$ in solution expressly for sterilizing the device upon wiping down the device with the swab after removal of both the device and the swab from the container prior to commencing the treatment procedure. A further swab is packaged in an additional sterile pack incorporated in the sterile package and impregnated with a solution containing a neutralizing agent expressly for use in wiping down the device after the wipe down with the first-mentioned swab to neutralize the $H_2O_2$ before placing the device in contact with blood and tissue of the body.

U.S. Pat. No. 5,871,763 (Luu et al.) discloses a substrate such as a wipe treated with a nongreasy lotion comprising an emollient and a retention/release agent. The lotion comprises a delta H above about 37° C. of about 10 calories/gram, a total heat of melting of above about 25 calories/gram, and an onset of melting temperature at least about 30° C.

U.S. Pat. No. 5,897,856 (Trinh et al.) discloses an odor absorbing wipe comprising a composition having from about 0.1% to about 5% of solubilized, water-soluble uncomplexed cyclodextrin, from about 0.01% to about 1% of low molecular weight polyols, and an aqueous carrier. The composition is deposited on a wipe which has a flexible dispensing means.

U.S. Pat. No. 5,938,013 (Palumbo et al.) discloses a pack having a body portion formed of flexible sheet material and defining an article receiving cavity. The body portion comprises a first end defined by an end wall and tapering to a second end spaced apart from the first end. The body portion comprises a face in which is defined a dispensing opening. A resealable sealing member is secured to the body portion and, in a closing position, covers the opening in sealing contact with the body portion around the periphery of the opening. A plurality of sheet-form articles is disposed within the cavity in the form of a flattenable roll, with one end of the roll being capable of extending through the opening.

U.S. Pat. No. 5,942,214 (Lucas et al.) discloses a method of controlling environmental malodors on skin. The method comprises applying to skin a composition comprising from about 0.1% to about 5% of solubilized, water-soluble, uncomplexed cyclodextrin; an aqueous carrier; from about 0.1% to about 36% of an oil phase selected from the group consisting of emollients, moisturizers, and skin protectants; a surfactant; and from about 0.004% to about 2% of a hydrophilic, volatile perfume composition.

U.S. Pat. No. 5,971,138 (Soughan) discloses a toiletry roll suitable to be mounted on the spindle of a dispenser. The roll comprises envelopes formed of flexible polymeric moisture-resistant film material and arrayed end-to-end to form a train of envelopes each having a radially inner wall, a radially outer wall, and a closure flap. The closure flap of each envelope is affixed to and extends from one of the walls of the envelope and is folded inwardly to envelope-closing position over and onto the exterior side of the other of the walls of the envelope. The train is wound on itself to form the roll. The closure flaps are held in envelope-closing position by the wound configuration of the roll. Each closure flap is, upon separation of its associated envelope from the roll, either opening incident to the separation or being readily openable by thumbing with-out peeling, tearing or unzipping each envelope containing at least one removable flushable wipe moistened with at least one skin-treating agent comprising skin cleaner.

U.S. Pat. No. 6,007,264 (Koptis) discloses a container and applicator combination. The combination comprises a container having top and bottom surfaces and first and second ends. The top and bottom surfaces have a length and width dimension defining a surface area sufficient in size to receive the thumb of a hand. The container may be gripped between the thumb and finger of a hand. The length and width dimension are greater than the thickness dimension between the top and bottom surfaces to define a relatively thin appearance. The container includes a dispensing outlet located at the second end. An applicator is attached to the container to define a unitary one-piece structure. The applicator comprises first and second wings, each of the wings being integrally attached to and extending outwardly from the second end of the container and being capable of being spread apart pivotally in opposite directions over a wide arc. The first wing is located to one side of the dispensing outlet and the second wing is located to an opposite side of the dispensing outlet. The first wing defines an applicator surface on an underside surface and the second wing defines an applicator surface on an upperside surface.

U.S. Pat. No. 6,028,018 (Amundson et al.) discloses a multilayer wet wipe. The wipe comprises from about 150 to about 600% of a liquid based on the dry weight of the wipe; a first nonwoven outer layer defining a first exterior surface of the wet wipe; a second nonwoven outer layer positioned with the first outer layer to define a second exterior surface of the wet wipe; and a nonwoven inner layer positioned between the first outer layer and the second outer layer. The outer layers comprise a first polymeric fiber comprising at least about 35% of the outer layers and a natural fiber comprising at least about 50% of the outer layers. The inner layer comprises a second polymeric fiber wherein the first and second polymeric fibers comprises different polymeric materials.

U.S. Pat. No. 6,029,809 (Skiba et al.) discloses a patient bathing system. The system comprises a sealed, flexible outer package, a means for gaining access to the interior of the outer package, and a washcloth for body cleansing disposed within the outer package. The washcloth comprises a blended cloth comprising first fibers and second fibers, with the quantity by weight of the first fibers being greater than the quantity by weight of the second fibers, and the blended cloth having an absorbency much greater by weight than the weight of the blended cloth, and a cleansing solution impregnating the blended cloth. The cleansing solution is distributed throughout the blended cloth and generally non-migratory unless disturbed such that the cleaning solution is released from the blended cloth, with the quantity of the cleansing solution being far less than the absorbency of the blended cloth.

U.S. Pat. No. Des. 396,596 (Simon) discloses a personal care textile article with a label. The ornamental design for a personal care textile article with label is as shown and described in the FIGS. 1–19.

As set out above, many types of compartmentalized storage systems are known. However, these storage systems have not been suitable to temporarily store and subsequently mix at least two different substances, especially non-compatible substances. The present invention provides such compartmentalized storage systems to temporarily store and subsequently mix at least two different substances.

IN THE FIGURES

SUMMARY OF THE INVENTION

Figure 1:
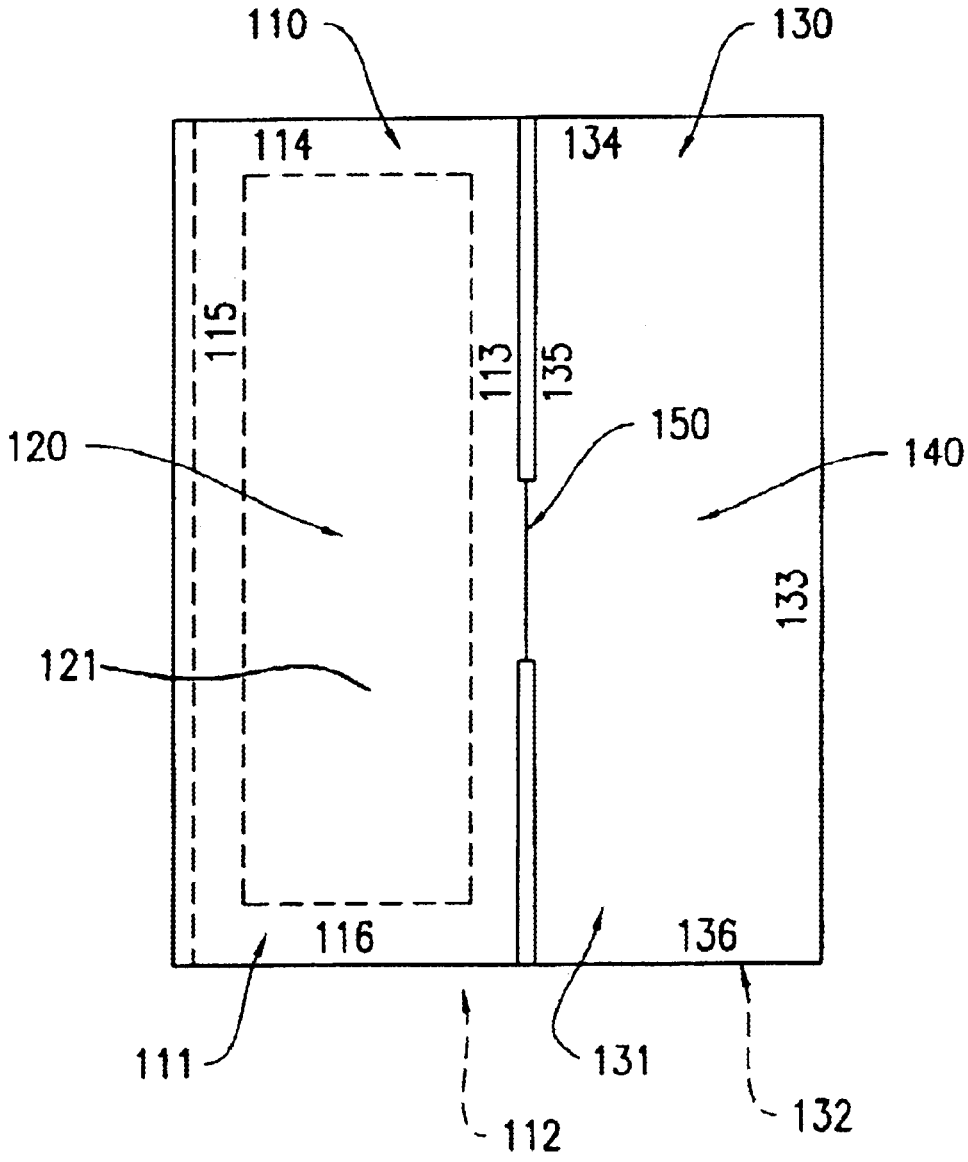
FIG. 1 shows a preferred embodiment of a compartmentalized storage system to temporarily store and subsequently mix at least two different substances in accord with the present invention. In this embodiment, the first and the second compartments are attached to each other by one common side.

The present invention is directed to a compartmentalized storage system for temporarily storing and subsequently mixing at least two different substances comprising:

(a) a first storing compartment having a front and a back and a plurality of sides, defining a first cavity portion, wherein a solid sorbing substrate and a first substance are stored in the first storing compartment; and (b) a second storing compartment having a front and a back and a plurality of sides, defining a second cavity portion, wherein a second substance is stored in the second storing compartment;

wherein the first and the second compartments are attached to each other by at least one common side, which common side comprises a frangible seal connecting the first and the second compartments, whereby upon by applying force to the frangible seal, the seal will break and thereby allow the second substance in the second storing compartment to be mixed with the solid sorbing substrate, such as a wipe, and the first substance in the first storing compartment.

In another embodiment, the invention is directed to a compartmentalized storage system for temporarily storing and subsequently mixing at least two different edible substances comprising:

(a) a first storing compartment having a front and a back, a plurality of sides, defining a first cavity portion, wherein a first edible substance is stored in the first storing compartment; and (b) a second storing compartment having a front and a back and a plurality of sides, defining a second cavity portion, wherein a second edible substance is stored in the second storing compartment;

wherein the first and the second compartments are attached to each other by at least one common side, which common side comprises a frangible seal connecting the first and the second compartments, whereby upon by applying force to the frangible seal, the seal will break and thereby allow the second edible substance in the second storing compartment to be mixed with the first edible substance in the first storing compartment.

In yet another embodiment, the invention is directed to a method for using a compartmentalized storage system to temporarily store and subsequently mix at least two different substances comprising the steps of:

(A) providing a compartmentalized storage system comprising:

(a) a first storing compartment having a front and a back, a plurality of sides, defining a first cavity portion, wherein a solid sorbing substrate, such as a wipe, and a first substance are stored in the first storing compartment; and (b) a second storing compartment having a front and a back and a plurality of sides, defining a second cavity portion, wherein a second substance is stored in the second storing compartment;

wherein the first and the second compartments are attached to each other by at least one common side, which common side comprises a frangible seal connecting the first and the second compartments, whereby upon by applying force to the frangible seal, the seal will break and thereby allow the second substance in the second storing compartment to be mixed with the solid sorbing substrate, such as a wipe, and the first substance in the first storing compartment;

(B) applying force to the frangible seal to break the seal and thereby allow the second substance in the second storing compartment to be mixed with the solid sorbing substrate, such as a wipe, and the first substance in the first storing compartment;

(C) applying force to the tearable seal to break the seal; and (D) removing the solid sorbing substrate, such as a wipe, mixed with the first substance and the second substance, through the broken tearable seal in the first storing compartment.

In yet another embodiment, the invention is directed to a method for using a compartmentalized storage system to temporarily store and subsequently mix at least two different edible substances comprising the steps of:

(A) providing a compartmentalized storage system for temporarily storing and subsequently mixing at least two different edible substances comprising:

(a) a first storing compartment having a front and a back, a plurality of sides, defining a first cavity portion, wherein a first edible substance is stored in the first storing compartment; and (b) a second storing compartment having a front and a back and a plurality of sides, defining a second cavity portion, wherein a second edible substance is stored in the second storing compartment;

wherein the first and the second compartments are attached to each other by at least one common side, which common side comprises a frangible seal connecting the first and the second compartments, whereby upon by applying force to the frangible seal, the seal will break and thereby allow the second edible substance in the second storing compartment to be mixed with the first edible substance in the first storing compartment;

(B) applying force to the frangible seal to break the seal and thereby allow the second edible substance in the second storing compartment to be mixed with the first edible substance in the first storing compartment;

(C) applying force to the tearable seal to break the seal; and (D) removing the first edible substance mixed with the second edible substance through the broken tearable seal in the first storing compartment.

DETAILED DESCRIPTION OF THE INVENTION

The present invention is directed to a compartmentalized storage system for temporarily storing and subsequently mixing at least two different substances such as in household and personal care product applications. In one embodiment, the compartmentalized storage system comprises a first storing compartment having a front and a back, a plurality of sides, and optionally a tearable seal. A solid sorbing substrate, such as a wipe, and a first substance are stored in the first storing compartment. The compartmentalized storage system further comprises a second storing compartment having a front and a back and a plurality of sides. A second substance is stored in the second storing compartment. The first and the second compartments are attached to each other by at least one common side, which common side comprises a frangible seal connecting the first and the second compartments. Upon by applying force to the frangible seal, the seal will break and thereby allow the second substance in the second storing compartment to be mixed with the solid sorbing substrate and the first substance in the first storing compartment.

In a preferred embodiment, a tearable seal and the frangible seal are located adjacent to each other such that pressure to open the tearable seal will break the frangible seal and thereby allow the second substance in the second storing compartment to be mixed with the solid sorbing substrate and the first substance in the first storing compartment in one step. The consumer then removes the solid sorbing substrate, mixed with the first substance and the second substance, through the broken tearable seal in the first storing compartment.

The compartmentalized storage system is preferably flexible, and the first and second storing compartments may be substantially rectangular. In one embodiment, the first and the second compartments are attached to each other by one common side. In another embodiment, the first and the second compartments are attached to each other by two common sides. In yet another embodiment, the first and the second compartments are attached to each other by more than two common sides. In a preferred embodiment, the tearable seal and the frangible seal are located adjacent to each other such that pressure to open the tearable seal will break the frangible seal. The first substance may be liquid, or may be solid. The second substance may be liquid or may be gaseous. Preferably, the first and second substances are substantially non-compatible. In one embodiment, the first and second substances are substantially non-compatible such that mixing the substances causes an exothermic or endothermic reaction. In another embodiment, the first and second substances are substantially non-compatible such that mixing the substances causes a foaming reaction. In another embodiment, the first and second substances are substantially non-compatible such that mixing the substances causes a color changing reaction. For examples, dye based indicator systems that change color after a specific usage period may be prepared. In another embodiment, the first and second substances are substantially non-compatible such that mixing the substances causes a fragrance or flavor changing reaction. In another embodiment, one of the first or second substances is a fragrance and the other of the first or second substances is a bleach. The compartmentalized storage system for temporarily storing and subsequently mixing at least two different substances may be used to prepapre a personal care wipe that contains a wipe on one side and an activating solution on the other side that can be used for cleaning, moisturizing, or other personal uses.

The present invention is also directed to a compartmentalized storage system for temporarily storing and subsequently mixing at least two different edible substances such as in food product applications. In this embodiment, the compartmentalized storage system comprises a first storing compartment having a front and a back, a plurality of sides, and optionally a tearable seal. A first edible substance is stored in the first storing compartment. The compartmentalized storage system further comprises a second storing compartment having a front and a back and a plurality of sides. A second edible substance is stored in the second storing compartment. The first and the second compartments are attached to each other by at least one common side, which common side comprises a frangible seal connecting the first and the second compartments. Upon applying force to the frangible seal, the seal will break and thereby allow the second edible substance in the second storing compartment to be mixed with the first edible substance in the first storing compartment.

In a preferred embodiment, the first edible substance is an oil phase and the second edible substances is an aqueous phase such as for preparing a salad dressing or a sauce. In another preferred embodiment, the first edible substance is milk and the second edible substances is dry cereal.

The compartmentalized storage system for temporarily storing and subsequently mixing two different edible substances may be employed to maintain two foods separately that can then be combined at the time of usage by breaking the frangible seal separating the compartments. Applications include salad dressings (oil and water phases), cereals (milk and dry cereal), sauces (spices and liquids), soups (water and dry materials), and many other edible products. The advantage to the compartmentalized storage system is that the freshness of the materials can be maintained by the physical separation between the components. This separation can have a positive effect on the taste of the food. Often with prepared foods, the character of the food is uniform because of the long term association of all of the components. By maintaining a separation between the different components until just prior to use, as in the present invention, an improved taste can be generated. Also a physical separation between food components until just prior to use can improve the nutritional stability of the food. This physical separation between food components can be particularly useful where long term stability is needed. This physical separation between food components can dramatically improve shelf life by allowing a rehydration of a dried food. This physical separation between food components also allows the combination of typically incompatible materials like spices, vinegar, etc. with the main body of the food at the time of use. The food may also undergo a physical transformation following the breaking of the frangible seal. For example, the final food product could be a foaming product, such as a product which is the result of mixing a bicarbonate with a weak acid such as acetic or citric acid.

The present invention is also directed to a method for using the compartmentalized storage system of the present invention to temporarily store and subsequently mix at least two different substances. The method comprises providing a compartmentalized storage system; applying force to the frangible seal to break the seal and thereby allow the second substance in the second storing compartment to be mixed with the solid sorbing substrate, such as a wipe, and the first substance in the first storing compartment; applying force to the tearable seal to break the seal; and removing the solid sorbing substrate, such as a wipe, mixed with the first substance and the second substance, through the broken tearable seal in the first storing compartment.

The present invention is also directed to a method for using a compartmentalized storage system of the present invention to temporarily store and subsequently mix at least two different edible substances. The method comprises providing a compartmentalized storage system; applying force to the frangible seal to break the seal and thereby allow the second edible substance in the second storing compartment to be mixed with the first edible substance in the first storing compartment; applying force to the tearable seal to break the seal; and removing the first edible substance mixed with the second edible substance through the broken tearable seal in the first storing compartment.

As set out above, the present invention is particularly useful when the first and second substances are substantially non-compatible. Substantially non-compatible means that the first and second substances react with each other. The exact amount of reaction permissable between the first and second substance may vary depending upon the level of reaction permissable or tolerable in the final product. In general, the amount of reaction permissable between the first and second substance is the ordinary amount tolerable without interfering with the practical or organoleptic properites of the final product. Such amounts of reaction are known to the skilled practitioner in the arts and are not a part of the present invention. In a preferred embodiment, the amount of reaction permissable between the first and second substance without interfering with the organoleptic properites of the final product is an amount from about 1% to about 35%, preferably from about 3% to about 30%, and more preferably from about 5% to about 25%. In a preferred embodiment, the time period for reaction permissable between the first and second substance permissable without interfering with the organoleptic properites of the final product is an amount from about 1 day to about 12 months, preferably from about 1 week to about 10 months, and more preferably from about 1 month to about 6 months.

The invention will be better understood from the following detailed description of the preferred embodiments taken in conjunction with the Figures, in which like elements are represented by like referenced numerals.

In FIG. 1, a compartmentalized storage system to temporarily store and subsequently mix at least two different substances, in accord with the present invention, is depicted generally as 100 and constructed in accordance with a preferred embodiment of the present invention.

Compartmentalized storage system 100 comprises a first storing compartment first (110), having a front (111) and a back (112), a plurality of sides (113, 114, 115, 116), respectively, and a tearable seal (117), defining a first cavity portion. A wipe (120) and a first substance (121) are stored in the first storing compartment (110).

Compartmentalized storage system 100 also comprises a second storing compartment (130) having a front (131) and a back (132) and a plurality of sides (133, 134, 135, 136), respectively, defining a second cavity portion. A second substance (140) is stored in the second storing compartment (130).

The first (110) and the second (130) compartments are attached to each other by at least one common side (113, 135), which common side (113, 135) comprises a frangible seal (150) connecting the first (110) and the second compartments (130). By applying force to the frangible seal (150), the seal (150) will break and thereby allow the second substance (140) in the second storing compartment (130) to be mixed with the wipe (120) and the first substance (121) in the first storing compartment (110).

Figure 2:
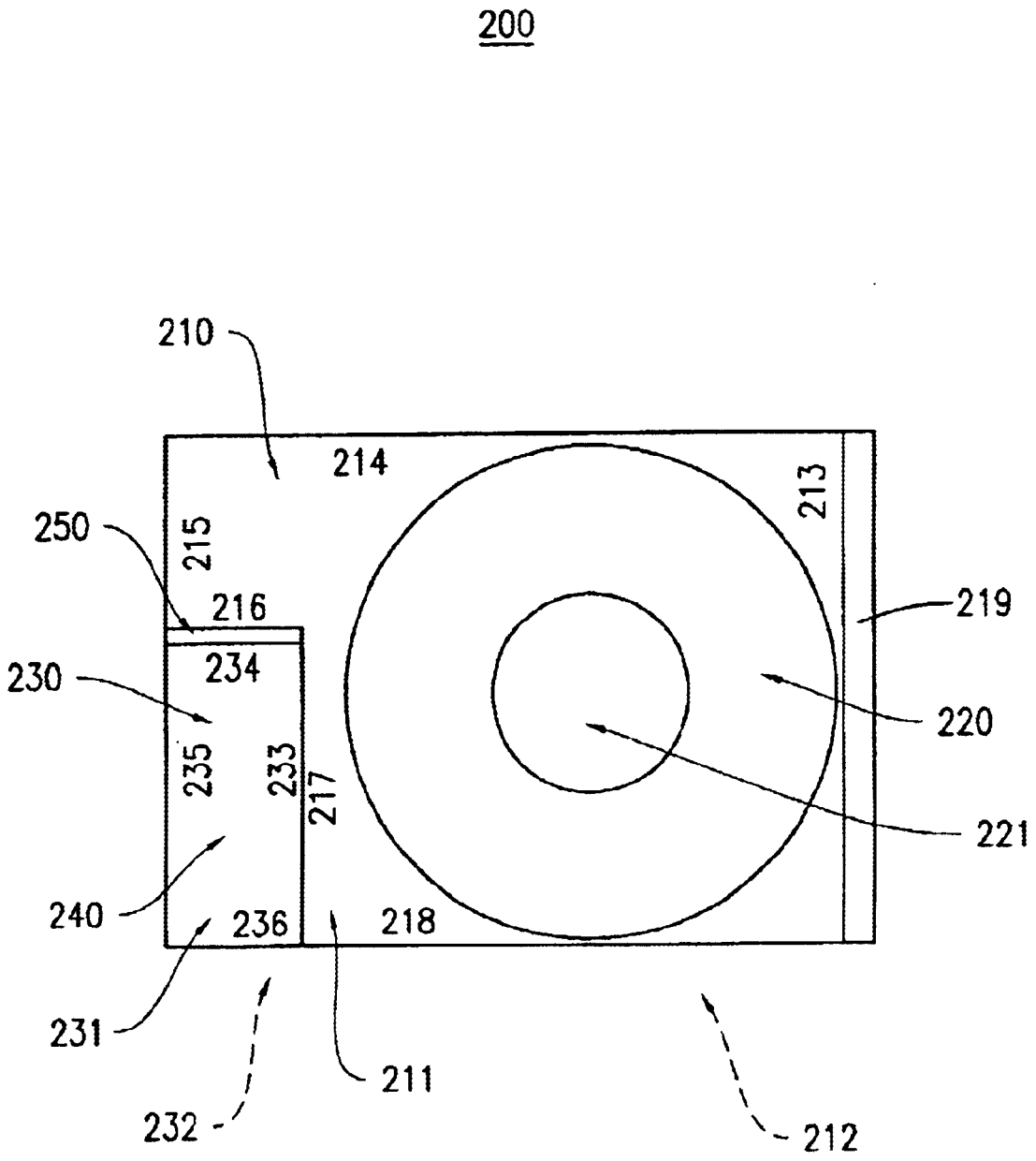
FIG. 2 shows another preferred embodiment of a compartmentalized storage system to temporarily store and subsequently mix at least two different substances in accord with the present invention. In this embodiment, the first and the second compartments are attached to each other by two common sides.

In FIG. 2, a compartmentalized storage system to temporarily store and subsequently mix at least two different substances, in accord with the present invention, is depicted generally as 200 and constructed in accordance with a preferred embodiment of the present invention. In this embodiment, the first and the second compartments are attached to each other by two common sides.

Compartmentalized storage system 200 comprises a first storing compartment first (210), having a front (211) and a back (212), a plurality of sides (213, 214, 215, 216, 217, 218), respectively, and a tearable seal (219), defining a first cavity portion. A wipe (220) and a first substance (221) are stored in the first storing compartment (210).

Compartmentalized storage system 200 also comprises a second storing compartment (230) having a front (231) and a back (232) and a plurality of sides (233, 234, 235, 236), respectively, defining a second cavity portion. A second substance (240) is stored in the second storing compartment (230).

The first (210) and the second (230) compartments are attached to each other by two common sides (216, 234 and 217, 233). One of the common sides (216, 234) comprises a frangible seal (250) connecting the first (210) and the second compartments (230). By applying force to the frangible seal (250), the seal (250) will break and thereby allow the second substance (240) in the second storing compartment (230) to be mixed with the wipe (220) and the first substance (221) in the first storing compartment (210).

Optionally, the first and the second compartments are attached to each other by more than two common sides. Compartmentalized storage system 200 may comprise a first storing compartment (210), having a front (211) and a back (212), a plurality of sides (213, 214 and **214*a*, 215*a* instead of 215, and 236*a* and 236), respectively, and a tearable seal (219)**, defining a first cavity portion.

Figure 3:
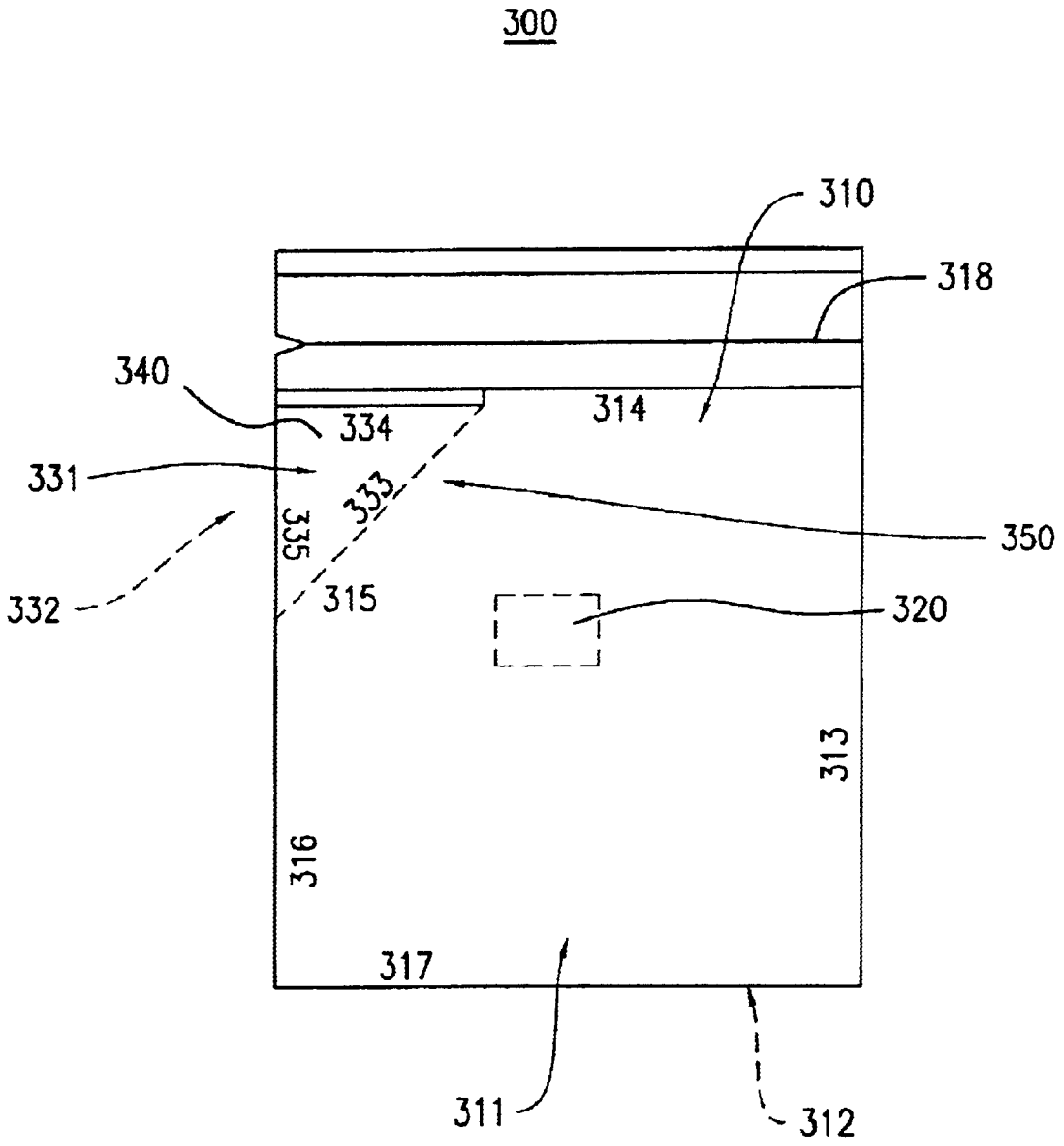
FIG. 3 shows another preferred embodiment of a compartmentalized storage system to temporarily store and subsequently mix at least two different edible substances in accord with the present invention. In this embodiment, the tearable seal and the frangible seal are located adjacent to each other such that pressure to open the tearable seal will break the frangible seal.

In FIG. 3, a compartmentalized storage system to temporarily store and subsequently mix at least two different edible substances, in accord with the present invention, is depicted generally as 300 and constructed in accordance with a preferred embodiment of the present invention. In this embodiment, the tearable seal and the frangible seal are located adjacent to each other such that pressure to open the tearable seal will break the frangible seal.

Compartmentalized storage system 300 comprises a first storing compartment first (310), having a front (311) and a back (312), a plurality of sides (313, 314, 315, 316, 317), respectively, and a tearable seal (318), defining a first cavity portion. A first edible substance (320) is stored in the first storing compartment (310).

Compartmentalized storage system 300 also comprises a second storing compartment (330) having a front (331) and a back (332) and a plurality of sides (333, 334, 335), respectively, defining a second cavity portion. A second edible substance (340) is stored in the second storing compartment (330).

The first (310) and the second (330) compartments are attached to each other by at least one common side (315, 333), which common side (315, 333) comprises a frangible seal (350) connecting the first (310) and the second compartments (330). By applying force to the frangible seal (350), the seal (350) will break and thereby allow the second edible substance (340) in the second storing compartment (330) to be mixed with the first edible substance (320) in the first storing compartment (310).

The following film specification was used to make the prototype samples of the compartmentalized storage system for temporarily storing and subsequently mixing at least two different substances of the present invention. The following type of packaging material may be used. Specification: Multi-laminated film comprising of a top layer of 50 gauge PVDC coated PET, followed by a layer of 10 guage PE and a final layer of 2 ml "SURLYN", which material actually forms the "frangible seal".

The present invention also provides a method for using a compartmentalized storage system to temporarily store and subsequently mix at least two different substances. The method comprises the steps of:

(A) providing a compartmentalized storage system comprising:

(a) a first storing compartment having a front and a back, a plurality of sides, and a tearable seal, defining a first cavity portion, wherein a solid sorbing substrate, such as a wipe, and a first substance are stored in the first storing compartment; and (b) a second storing compartment having a front and a back and a plurality of sides, defining a second cavity portion, wherein a second substance is stored in the second storing compartment;

wherein the first and the second compartments are attached to each other by at least one common side, which common side comprises a frangible seal connecting the first and the second compartments, whereby upon by applying force to the frangible seal, the seal will break and thereby allow the second substance in the second storing compartment to be mixed with the solid sorbing substrate, such as a wipe, and the first substance in the first storing compartment;

(B) applying force to the frangible seal to break the seal and thereby allow the second substance in the second storing compartment to be mixed with the solid sorbing substrate, such as a wipe, and the first substance in the first storing compartment;

(C) applying force to the tearable seal to break the seal; and (D) removing the solid sorbing substrate, such as a wipe, mixed with the first substance and the second substance, through the broken tearable seal in the first storing compartment.

The present invention also provides a method for using a compartmentalized storage system to temporarily store and subsequently mix at least two different edible substances comprising the steps of:

(A) providing a compartmentalized storage system for temporarily storing and subsequently mixing at least two different edible substances comprising:

(a) a first storing compartment having a front and a back, a plurality of sides, and a tearable seal, defining a first cavity portion, wherein a first edible substance is stored in the first storing compartment; and (b) a second storing compartment having a front and a back and a plurality of sides, defining a second cavity portion, wherein a second edible substance is stored in the second storing compartment;

wherein the first and the second compartments are attached to each other by at least one common side, which common side comprises a frangible seal connecting the first and the second compartments, whereby upon by applying force to the frangible seal, the seal will break and thereby allow the second edible substance in the second storing compartment to be mixed with the first edible substance in the first storing compartment;

(B) applying force to the frangible seal to break the seal and thereby allow the second edible substance in the second storing compartment to be mixed with the first edible substance in the first storing compartment;

(C) applying force to the tearable seal to break the seal; and (D) removing the first edible substance mixed with the second edible substance through the broken tearable seal in the first storing compartment.

The invention being thus described, it will be obvious that the same may be varied in many ways. Such variations are not to be regarded as a departure from the spirit and scope of the invention and all such modifications are intended to be included within the scope of the following claims.

What is claim is:

1. A compartmentalized storage system for temporarily storing and subsequently mixing at least two different substances comprising:

(a) a first storing compartment having a front and a back and a plurality of sides, defining a first cavity portion, and a tearable seal, wherein a solid sorbing substrate and a first substance are stored in the first storing compartment; and (b) a second storing compartment having a front and a back and a plurality of sides, defining a second cavity portion, wherein a second substance is stored in the second storing compartment;

wherein the first and the second compartments are attached to each other by at least one common side, which common side comprises a frangible seal connecting the first and the second compartments, wherein the tearable seal and the frangible seal are located adjacent to each other such that pressure to open the tearable seal will break the frangible seal and thereby allow the second substance in the second storing compartment to be mixed with the solid sorbing substrate and the first substance in the first storing compartment.

2. The compartmentalized storage system according to claim 1, wherein the storage system is flexible.

3. The compartmentalized storage system according to claim 1, wherein the first and the second compartments are attached to each other by one common side.

4. The compartmentalized storage system according to claim 1, wherein the first substance is liquid.

5. The compartmentalized storage system according to claim 1, wherein the first substance is solid.

6. The compartmentalized storage system according to claim 1, wherein the second substance is liquid.

7. The compartmentalized storage system according to claim 1, wherein the second substance is gaseous.

8. The compartmentalized storage system according to claim 1, wherein the first and second substances are substantially non-compatible.

9. The compartmentalized storage system according to claim 8, wherein the first and second substances are substantially non-compatible such that mixing the substances causes an exothermic or endothermic reaction.

10. The compartmentalized storage system according to claim 8, wherein the first and second substances are substantially non-compatible such that mixing the substances causes a foaming reaction.

11. The compartmentalized storage system according to claim 8, wherein the first and second substances are substantially non-compatible such that mixing the substances causes a color changing reaction.

12. The compartmentalized storage system according to claim 8, wherein the first and second substances are substantially non-compatible such that mixing the substances causes a fragrance changing reaction.

13. The compartmentalized storage system according to claim 8, wherein one of the first or second substances is a fragrance and the other of the first or second substances is a bleach.

14. The compartmentalized storage system according to claim 1, wherein the solid sorbing substrate is a wipe.

15. A method for using a compartmentalized storage system to temporarily store and subsequently mix at least two different substances comprising the steps of:

(A) providing a compartmentalized storage system comprising:

(a) a first storing compartment having a front and a back, a plurality of sides, defining a first cavity portion, and a tearable seal, wherein a solid sorbing substrate and a first substance are stored in the first storing compartment; and (b) a second storing compartment having a front and a back and a plurality of sides, defining a second cavity portion, wherein a second substance is stored in the second storing compartment;

wherein the first and the second compartments are attached to each other by at least one common side, which common side comprises a frangible seal connecting the first and the second compartments, wherein the tearable seal and the frangible seal are located adjacent to each other such that pressure to open the tearable seal will break the frangible seal and thereby allow the second substance in the second storing compartment to be mixed with the solid sorbing substrate and the first substance in the first storing compartment;

(B) applying force to the tearable seal to break the seal and thereby allow the second substance in the second storing compartment to be mixed with the solid sorbing substrate and the first substance in the first storing compartment; and (C) removing the solid sorbing substrate, mixed with the first substance and the second substance, through the broken tearable seal in the first storing compartment.

* * * * *